US008933309B2

(12) United States Patent
Oba et al.

(10) Patent No.: US 8,933,309 B2
(45) Date of Patent: Jan. 13, 2015

(54) SIMULATING MUTING IN A DRIVE CONTROL DEVICE FOR STRIKING MEMBER IN SOUND GENERATION MECHANISM

(71) Applicant: Yamaha Corporation, Hamamatsu-shi, Shizuoka-Ken (JP)

(72) Inventors: Yasuhiko Oba, Hamamatsu (JP); Rei Furukawa, Hamamatsu (JP); Yuji Fujiwara, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 14/077,480

(22) Filed: Nov. 12, 2013

(65) Prior Publication Data

US 2014/0130652 A1 May 15, 2014

(30) Foreign Application Priority Data

Nov. 12, 2012 (JP) ..... 2012-248703

(51) Int. Cl.
*G10F 1/02* (2006.01)

(52) U.S. Cl.
USPC ..... 84/21; 84/20; 84/17

(58) Field of Classification Search
USPC ..... 84/17–21
See application file for complete search history.

(56) References Cited

U.S. PATENT DOCUMENTS 4,619,176 A * 10/1986 Isii ..... 84/610
5,335,574 A 8/1994 Matsunaga et al.
5,451,706 A * 9/1995 Yamamoto et al. ..... 84/34
5,655,051 A * 8/1997 Furuta et al. ..... 386/246
5,696,343 A * 12/1997 Nakata ..... 84/609
5,967,792 A * 10/1999 Matsumoto ..... 434/307 A
7,129,406 B2 * 10/2006 Sakurada ..... 84/609
7,259,314 B2 * 8/2007 Kobayashi et al. ..... 84/604
7,265,281 B2 * 9/2007 Sasaki et al. ..... 84/13
7,405,350 B2 * 7/2008 Sasaki ..... 84/13
8,149,339 B2 * 4/2012 Ishii ..... 348/731
2003/0058486 A1 * 3/2003 Ogawa et al. ..... 358/479
2005/0257666 A1 * 11/2005 Sakurada ..... 84/609
2006/0225561 A1 * 10/2006 Kobayashi et al. ..... 84/604
2006/0275631 A1 * 12/2006 Rosenberg ..... 429/8
2010/0128183 A1 * 5/2010 Ishii ..... 348/726
2013/0199357 A1 * 8/2013 Soejima ..... 84/467
2014/0130652 A1 * 5/2014 Oba et al. ..... 84/12

FOREIGN PATENT DOCUMENTS

JP 05289657 A 11/1993

* cited by examiner

*Primary Examiner* — David S. Warren
(74) *Attorney, Agent, or Firm* — Rossi, Kimms & McDowell LLP

(57) ABSTRACT

A sound generation mechanism, provided with a string for generating a vibration sound in response to striking by a hammer, is automatically played in accordance with performance data. The performance data include striking data (note-on event data) for designating timing at which the string should be struck by the hammer, velocity data indicative of an intensity of the striking, and muting data (soft pedal data) for controlling muting. A controller determines drive start timing of the hammer in accordance with the velocity data in such a manner that the string is struck by the hammer at the timing designated by the striking data and performs control such that the drive start timing is advanced in accordance with the muting data. Thus, the string is struck at the striking timing designated by the striking data, but also muting control is performed in accordance with the muting data.

7 Claims, 6 Drawing Sheets

| DELTA TIME | TYPE | FIRST PARAMETER | SECOND PARAMETER |
|---|---|---|---|
| 12 | CONTROL CHANGE | 67 (SOFT PEDAL) | 78 (SOFT LEVEL) |
| 48 | NOTE-ON | 58 (NOTE NO.) | 64 (VELOCITY) |
| 24 | NOTE-OFF | 58 (NOTE NO.) | 0 |
| ... | ... | ... | ... |

| TIMING | SOFT LEVEL |
|---|---|
| 0m 0s 25ms | 78 |
| 0m 5s 75ms | 0 |
| ... | ... |

SIMULATING MUTING IN A DRIVE CONTROL DEVICE FOR STRIKING MEMBER IN SOUND GENERATION MECHANISM

BACKGROUND

The present invention relates generally to simulating muting in a drive control device for a striking member in a sound generation mechanism. For example, the present invention relates to auto-playing musical instruments provided with an automatic performance function, such as pianos, celestas and glockenspiels, and more particularly to drive control of a striking member, such as a hammer, provided in an auto-playing musical instrument.

Auto-playing pianos have been known as an example of acoustic musical instruments that execute an automatic performance in accordance with performance instructing data. Generally; auto-playing pianos include a drive mechanism that drives hammers provided in an ordinary piano, and a control device that controls driving, by the drive mechanism, of the hammers. The control device of the auto-playing piano controls behavior of the drive mechanism to drive the hammers, provided in corresponding relation to strings (more specifically, sets of stings), in accordance with performance instruction data indicative of pitches of strings (sets of strings) that should be struck by the hammers and string striking timing and intensity. As a consequence, a music piece is automatically performed or played by the auto-playing piano.

Some musical instruments, such as pianos, having sounding members (strings in the case of pianos) each of which can vibrate by being struck by a corresponding one of the hammers to thereby generate a particular sound (or tone), are provided with a muting mechanism. For example, many of the pianos include a soft pedal mechanism as the muting mechanism. Normally; in the muting mechanism of a grand-type piano, an entire hammer mechanism is caused to shift rightward relative to the strings in response to a human player depressing the soft pedal. Thus, some persons skilled in the art may call the muting mechanism a "shift pedal". Thus, for convenience of description in this specification, the muting mechanism (including the mechanism called "shift pedal mechanism") provided in the piano will hereinafter be referred to as "soft pedal mechanism", and a pedal provided in the soft pedal mechanism will hereinafter be referred to as "soft pedal".

In the case of a grand-type piano, once a key is struck or depressed with the soft pedal of the soft pedal mechanism depressed, the set of strings (one or more strings) corresponding to the depressed key is struck by the corresponding hammer with the position of the hammer displaced perpendicularly to a direction in which the strings extend (i.e., string-extending direction). Due to such displacement of the hammer, the number of the strings struck by the one hammer decreases, or a position of the hammer striking the strings shifts toward an end of the strings (more specifically, an end of the set of strings), as compared to a case where the key is struck or depressed with the soft pedal not depressed. Thus, generally, a sound audibly generated from the piano with the soft pedal depressed will give a listener a softer impression.

Further, in the case of an uptight-type piano, once a key is struck or depressed with the soft pedal of the soft pedal mechanism depressed, the corresponding strings are struck by the hammer whose pivoting movement is started at a position closer to the strings than normal. Thus, in this case, the hammer strikes the strings at a low velocity as compared to a case where the strings are struck by the hammer with the soft pedal not depressed. As a consequence, a sound of a smaller volume will be generated from the piano.

There has also been known a technique for executing an automatic perfomiance of a music piece, involving muting, in accordance with performance instruction data including data (muting data) indicative of present/absence or depths of depression of the soft pedal. For example, in an auto-playing piano disclosed in Japanese Patent Application Laid-open Publication No. HE-5-289657 (hereinafter referred to as "Patent Literature 1"), if soft pedal event information, indicating presence/absence of depression of the soft pedal at the time of generation of an ON event instructing striking of a key, is indicative of "ON", then conversion of key striking intensity information is executed, so that the key is driven in accordance with the converted key striking intensity information. As a result, an automatic performance imparted with a muting effect is executed without the soft pedal mechanism being driven.

In the case of the auto-playing piano disclosed in Patent Literature 1, if muting is instructed by the muting data when striking of a key has been instructed by the performance instruction data, an average electric power to be input to a corresponding key solenoid, which drives the hammer via the key, is reduced by conversion of the key striking intensity information. As a consequence, a string striking velocity of the hammer decreases so that a weak sound is generated from the corresponding strings, as compared to a case where conversion of the key striking intensity information is not executed.

If muting has been executed by merely converting the key striking intensity information to thereby reduce hammer driving force, a moving velocity of the hammer decreases without drive start timing of the hammer being changed, so that timing at which the hammer strikes the corresponding strings (string striking timing) would get delayed. FIG. 9 is a graph showing how the string striking timing is displaced when muting has been executed by mere conversion of the key striking intensity information. In FIG. 9, the horizontal axis represents elapsed times from start timing of key depression by the key solenoid, while the vertical axis represents depths of the key depression. As the key is depressed by the key solenoid, the hammer contacting the depressed key is driven to move toward the corresponding strings. Therefore, the depth of the key depression is proportional to a distance between the hammer and the strings.

In FIG. 9, (a) shows variation over time of the depth of the key depression from the key depression start time to the string striking time in a case where muting is not executed, and (b) shows variation over time of the depth of the key depression from the key depression start timing to the string striking timing in a case where muting is executed. As shown by these graph curves, string striking timing $T_2$ in the case where muting is executed would lag behind string striking timing $T_1$ in the case where muting is not executed.

SUMMARY OF THE INVENTION

In view of the foregoing prior art problems, it is an object of the present invention to provide a technique which allows muting to be appropriately simulated without involving deviation of sound generation timing.

In order to accomplish the above-mentioned object, the present invention an improved drive control device for a striking member in a sound generation mechanism, the sound generation mechanism including a sounding member adapted to generate a vibration sound in response to being struck by the striking member, which comprises: a reception section adapted to receive performance data, the performance data including striking data for designating striking timing at which the sounding member should be struck by the striking member, velocity data indicative of an intensity of striking, by the striking member, of the sounding member, and muting data for controlling muting of a sound; and a controller adapted to determine drive start timing of the striking member in accordance with the velocity data in such a manner that the sounding member is struck by the striking member at the striking timing designated by the striking data, perform control such that the drive start timing is advanced in accordance with the muting data.

The velocity data indicative of an intensity of striking, by the striking member, of the sounding member is data that functions to increase a striking velocity of the striking member as a striking intensity increases. Namely, in response to a greater striking velocity, the striking member strikes the sounding member with a greater intensity to thereby increase a volume of a vibration sound to be generated. According to the present invention, drive start timing of the striking member is determined in accordance with the velocity data such that the sounding member is struck by the striking member at the striking timing designated by the striking data. Thus, for a particular striking time point, the smaller the striking intensity indicated by the velocity data, the earlier is made the drive start timing of the striking member; conversely, the greater the striking intensity indicated by the velocity data, the later is made the drive start timing of the striking member. Thus, irrespective of the value of the velocity data, the sounding member can be struck at the striking timing designated by the striking data, but also sound volume control can be performed in accordance with the value of the velocity data. Additionally, according to the present invention, control is performed to make earlier or advance the drive start timing of the striking member, determined in accordance with the velocity data, in accordance with the muting data. Namely, control is performed such that, when the striking is to be made weaker, the drive start timing of the striking member is made earlier and the striking member moves while following a slow striking trajectory; to thereby achieve muting control corresponding to the muting data. In this way, irrespective of the value of the muting data, the sounding member is struck at the striking timing designated by the striking data, but also muting control is performed in accordance with the value of the muting data. As a result, the present invention can appropriately simulate muting without involving deviation of sound (tone) generation timing. Note that, in this specification, the term "sound" is used here interchangeably with the term "tone".

Namely, according to the present invention, the sounding member is struck at the timing designated by the striking data irrespective of presence/absence or degree of muting. Thus, in a case where the drive control device of the present invention is applied to an automatic performance executed on an acoustic musical instrument, such as a piano, an automatic performance involving muting can be executed on the acoustic musical instrument at accurate sound (tone) generation timing. Note that, in the case where the drive control device of the present invention is applied to a piano, the sounding member is a string (or set of strings) of the piano, and the striking member is a string striking hammer driven in response to key depression.

As an example, the controller may change the velocity data, indicative of an intensity of striking, to weaken the striking in accordance with the muting data, and the controller may create, in accordance with the changed velocity data, a trajectory of time-vs.-movement-positions of the striking member such that the sounding member is struck by the striking member at the striking timing designated by the striking data. In this case, a striking velocity based on the velocity data is itself controlled in accordance with the muting data.

As another example, the controller may create the trajectory of time-vs.-movement-positions of the striking member such that driving of the striking member is controlled with acceleration corresponding to the muting data and that the sounding member is struck by the striking member at the striking timing designated by the striking data and with an intensity indicated by the velocity data, in this case, a velocity at which the sounding member is struck by the striking member is a striking velocity set in accordance with the velocity data, and acceleration with which the striking member is moved until it reaches the striking velocity; set in accordance with the velocity data, is set in accordance with the muting data.

According to another aspect of the present invention, there is provided an auto-playing musical instrument, which comprises: the aforementioned drive control device; a plurality of the sounding members; a plurality of the striking members each configured to strike a corresponding one of the sounding members; and a drive mechanism configured to individually drive the plurality of the striking members under control of the controller.

The present invention may be constructed and implemented not only as the apparatus invention discussed above but also as a method invention. Also, the present invention may be arranged and implemented as a software program for execution by a processor, such as a computer or DSP, as well as a non-transitory computer-readable storage medium storing such a software program. In this case, the program may be provided to a user in the storage medium and then installed into a computer of the user, or delivered from a server apparatus to a computer of a client via a communication network and then installed into the client's computer. Further, the processor used in the present invention may comprise a dedicated processor with dedicated logic built in hardware, not to mention a computer or other general-purpose processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION

Figure 1:
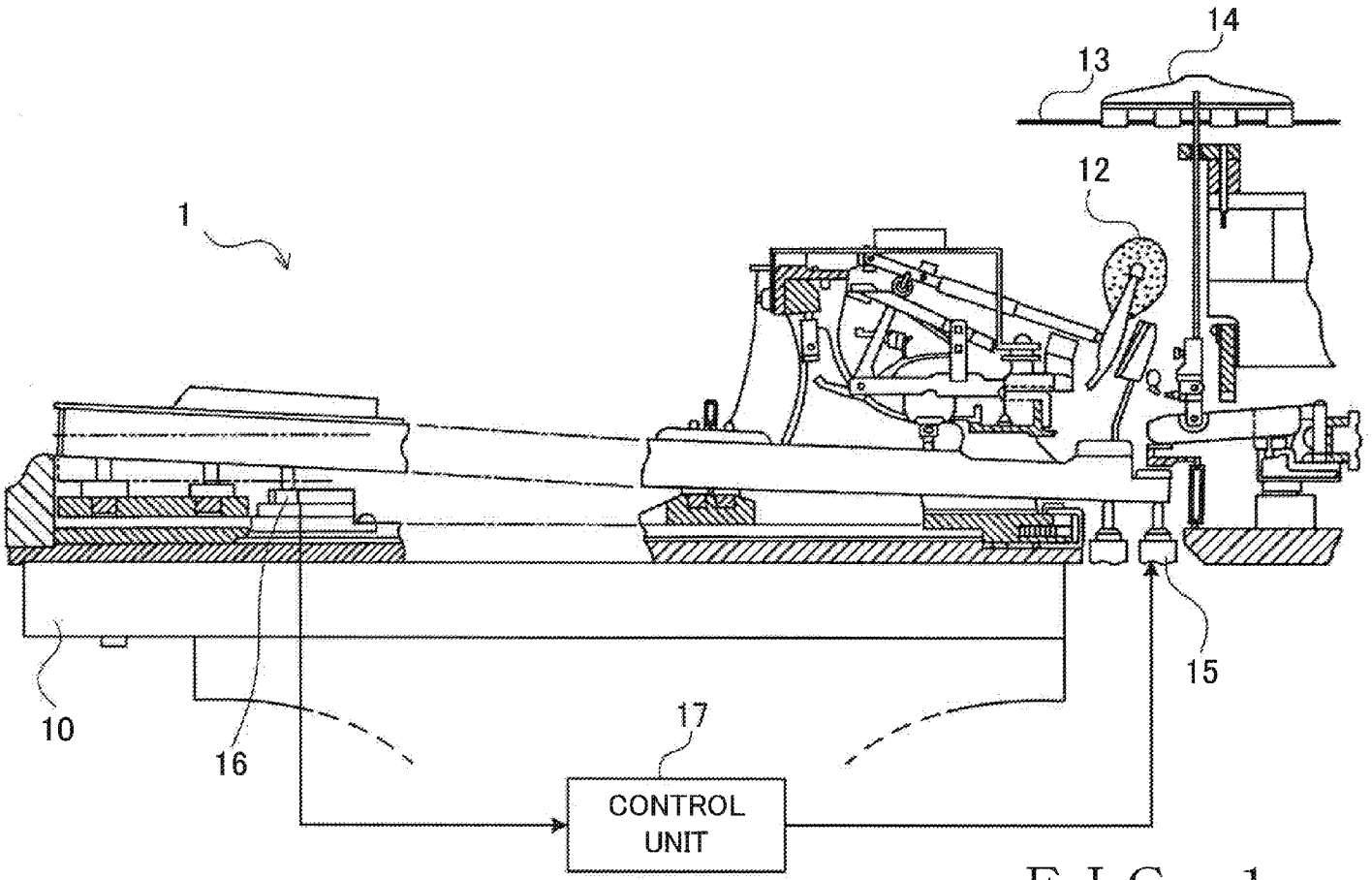
FIG. 1 is a view showing a construction of an auto-playing piano according to a preferred embodiment of the present invention.

FIG. 1 is a side view showing a construction of an auto playing piano 1 according to a preferred embodiment of the present invention. The auto-playing piano 1 executes an automatic performance by driving keys via key solenoids in accordance with performance instruction data. The construction of the auto-playing piano 1 is similar to that of the conventionally-known auto-playing piano, except for later-described drive control of the key solenoid. Thus, the following description will center on a part of the construction of the piano 1 essential to the present invention.

As structural components similar to those of the conventional piano, the auto-playing piano 1 includes: a plurality of keys 11 provided on a shelf board 10; a plurality of hammers 12 provided in corresponding relation to the plurality of keys 11 and configured to pivot in response to depression of the corresponding keys 11; a plurality of sets of strings 13 each constituting a sounding member comprising one to three strings depending on the corresponding key 11 and configured to generate a sound of a predetermined pitch by vibrating in response to being struck by the hammer 12 pivoting in response to depression of the corresponding key 11; and a plurality of dampers 14 provided in corresponding relation to the keys 11 and normally urged in an up-to-down direction against the corresponding strings (i.e., set of one or more strings) 13, each of the hammers 12 moving away from the corresponding strings 13 in response to depression of the corresponding key 11. Namely, the piano 1 comprises a sounding mechanism (sound generation mechanism) including striking members and sounding members each adapted to generate a vibration sound in response to being struck by the corresponding striking member, and the hammers 12 are the striking members while the strings (sets of strings) 13 are the sounding members.

Further, as structural components for implementing an automatic performance function, the auto-playing piano 1 includes: a plurality of key solenoids 15 provided in corresponding relation to the keys 11 and each configured to push up a rear end portion of the corresponding key 11, farther from a human player of the piano 1, to thereby drive the key 11; a plurality of key sensors 16 provided in corresponding relation to the keys 11 and each configured to measure positions, in an up-down or vertical direction, of the corresponding keys 11, i.e. a depth of depression of the key 11; and a control unit 17 that controls driving, by the key solenoid 15, of each of the keys 11 by supplying the key solenoid 15 with a PWM (Pulse Width Modulation) signal of an energizing width corresponding to a duty cycle required to move the key 11 from a current position to a target position in a target time. Namely, a drive control device for the striking members (i.e., hammer drive control device) according to the present invention comprises mainly the key solenoids 15 and the control unit 17.

Figures 2, 3:
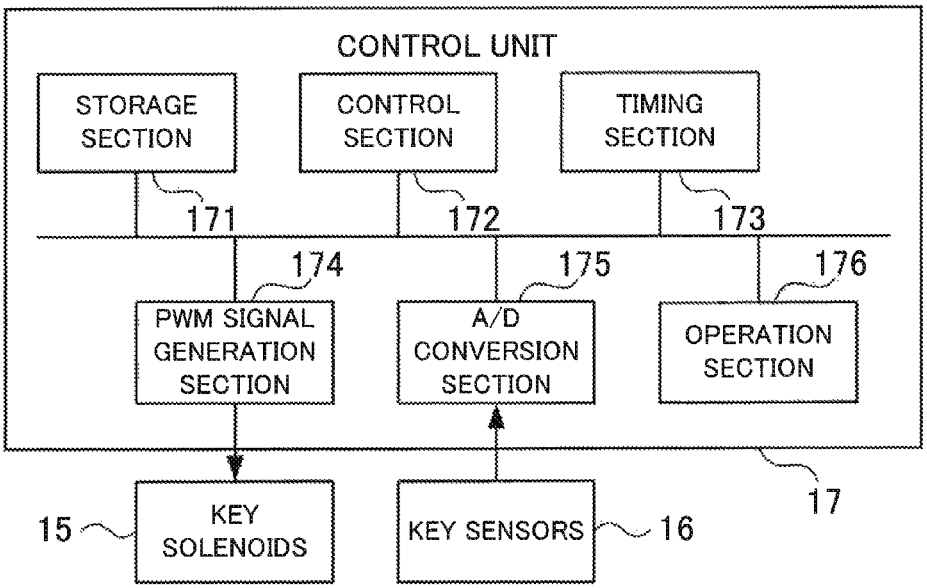
FIG. 2 is a diagram showing a construction of a control unit in the embodiment of the present invention.
FIG. 3 is a diagram schematically showing an example organization of performance data instructing an automatic performance.

FIG. 2 is a diagram showing a construction of the control unit 17. The control unit 17 includes: a storage device 171 storing therein various data, such as program data indicative of a computer program instructing a controller 172 to perform various processing and performance data instructing the controller 172 to perform a music performance; the controller 172 that controls behavior of other components of the control unit 17; a timer 173 that continuously measures an elapsed time from a reference time to generate time data indicative of a current time; a PWM signal generator 174 that generates a PWM signal of a duty cycle corresponding to an instruction given from the controller 172 and outputs the generated PWM signal to the key solenoid 15 corresponding to the instruction given from the controller 172; an A/D (Analog-to-Digital) converter 175 that converts analog key position data, indicative of positions of the keys 11 input from the individual key sensors 16, into digital data; and an operation section 176 that generates predetermined data in response to operations performed by the user on the control unit 17 for giving instructions for starting and ending an automatic performance and the like. The controller 172 comprises a microprocessor or a computer.

Note that, in the instant embodiment, a structural arrangement for allowing the controller 172 to receive the performance data read out from the storage device 171 functions as a reception section adapted to receive the performance data. However, the reception section adapted to receive the performance data is not so limited and may be arranged or constructed to receive performance data supplied in real time from outside. Further, the key solenoids 15 provided individually in corresponding relation to the keys 11 constitute a mechanism configured to drive or depress the corresponding keys 11 in accordance with selection based on the performance data and thereby drive the hammers 12 corresponding to the keys 11. Further, the controller 172, the timer 173, the PWM signal generator 174 and the A/D converter 175 together constitute, in conjunction with the key sensors 16, a controller that controls behavior of the key solenoids 15 constituting the drive mechanism.

FIG. 3 is a diagram schematically showing an example organization of performance data stored in the storage device 171. The performance data are, for example, data compliant with the SMF (Standard MIDI File) format of the MIDI (Musical Instrument Digital Interface) standards, which instruct a musical instrument, provided with an automatic performance function, to execute a performance by indicating a pitch of each tone to be generated, timing ("note-on") at which the tone is should be audibly generated, intensity (velocity) at which the tone should be generated, timing ("note-off") at which a tone being generated should be deadened or silenced, etc. Further, the performance data employed in the instant embodiment include, as muting data, data indicative of a depth of depression of the soft pedal (soft pedal data). Further, note-on event data in the performance data is striking data for designating timing at which the sounding member (set of strings 13) should be struck by the striking member (hammer 12). Furthermore, velocity data included in the note-on event data is data indicative of an intensity of the striking by the striking member (hammer 12).

Of the various data illustrated in FIG. 3, data at the first line ("control change event data") is soft pedal data in which a first parameter is indicative of soft pedal data and a second parameter is data indicative of a depth of depression of the soft pedal muting data for controlling muting). The data indicative of a depth of depression of the soft pedal will hereinafter be referred to simply as "soft level". Note that the soft level is indicated by an integral number in a range of "0" to "127". If the value of the soft level is "0", it indicates that the soft pedal is not being depressed, and a greater value of the soft level indicates a greater depth of depression of the soft pedal (i.e., greater degree of muting).

Further, of the data illustrated in FIG. 3, data at the second line is note-on event data instructing generation of a tone, in which a first parameter is indicative of a pitch (note No.) of the tone to be generated and a second parameter is velocity data indicative of a volume level at which the tone should be generated (i.e., intensity of striking by the hammer or striking velocity). The first parameter of the note-on event data is indicated by an integral number in a range of "0" to "127", and a greater value of the note-on event data indicates a tone of a higher pitch. The second parameter of the note-on event data is indicated by an integral number in a range of "0" to "127", and a greater value of the second parameter (velocity value) indicates a volume level at which the tone should be generated (striking intensity). If the velocity value is "0", it indicates a zero volume level silencing level), and a greater velocity value indicates that the tone should be generated at a greater volume level.

Furthermore, of the various data illustrated in FIG. 3, data at the third line is note-off event data instructing that a currently-generated tone be silenced, in which a first parameter indicates a pitch of the tone to be silenced and a second parameter is normally maintained at value "0" and not used although it may sometimes be used for an expression of the tone. Note that the control change event data (e.g., soft pedal data), note-on event data and note-off event data will hereinafter be referred to generically as "event data".

Each of the event data included in the performance data shown in FIG. 3 includes data called "delta time". The delta time indicates timing at which an operation (process) should be performed in accordance with the current event data, by an elapsed time from timing at which an operation (process) should be performed in accordance with the last event data. A value of the delta time indicates a relative time, and thus, an absolute time from, for example, start timing of a music piece cannot be identified from the delta time alone. Therefore, in addition to the data shown in FIG. 3, the performance data include time unit data indicative of a delta time corresponding to a length of a quarter note, and tempo data indicative of the length of the quarter note in microseconds. The delta time included in each of the event data can be used after being converted into an absolute time in accordance with such time unit data and tempo data.

Figure 4:
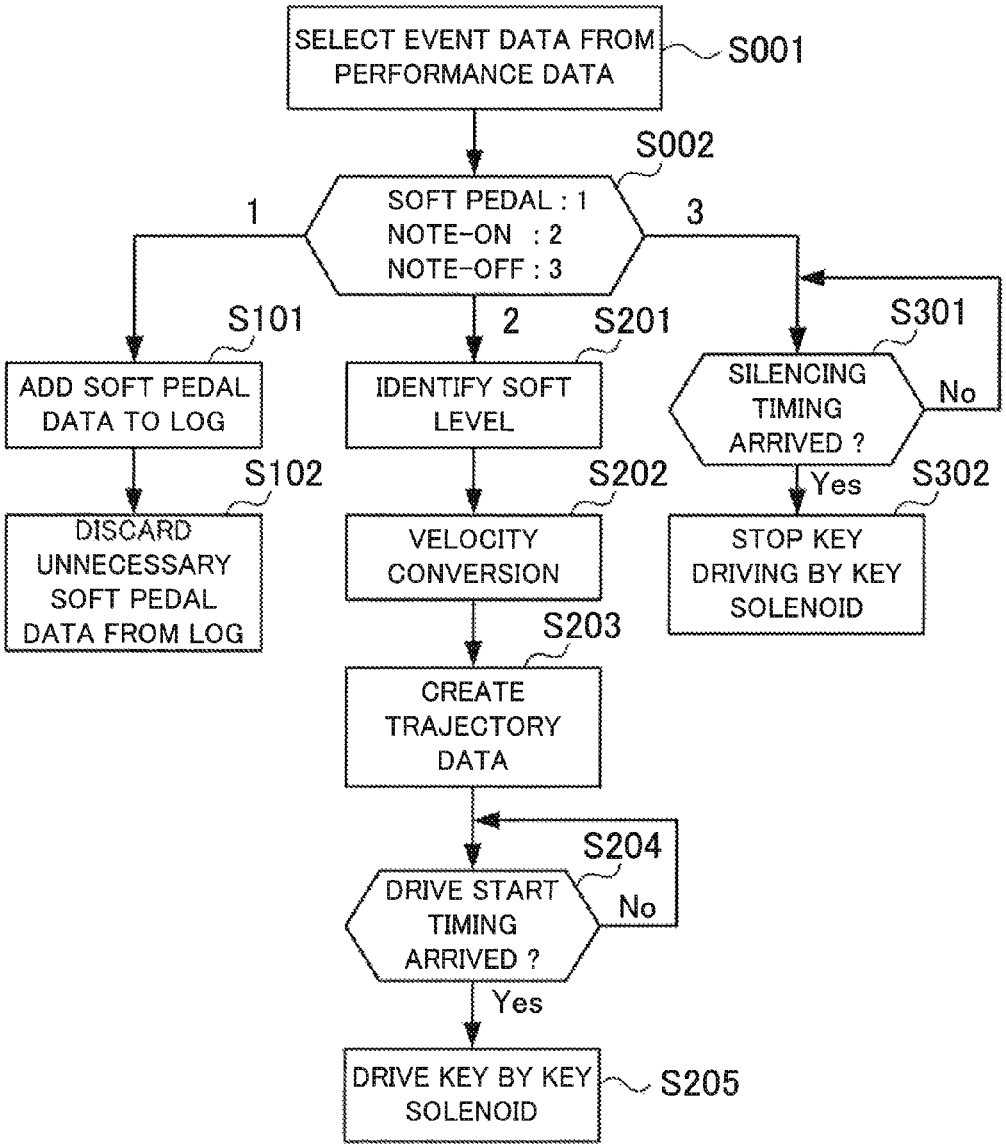
FIG. 4 is a flow chart showing an example operational sequence of processing performed by a controller in the embodiment of the present invention.

FIG. 4 is a flow chart showing an example operational sequence of processing perforated by the controller 172 of the control unit 17 for controlling the behavior of the key solenoids 15 in accordance with the performance data of a music piece. At step S001, the controller 172 reads out and receives the performance data from the storage device 171 and selects a plurality of event data, included in the performance data, one by one from the beginning. For each of the event data sequentially selected like this, the controller 172 first identifies or determines the type of the event data at step S002.

If the event data has been determined to be soft pedal data at step S002 (i.e., "1" at step S002), the controller 172 adds data indicative of content of the soft pedal data to soft pedal log data at step S101.

Figures 5, 6:
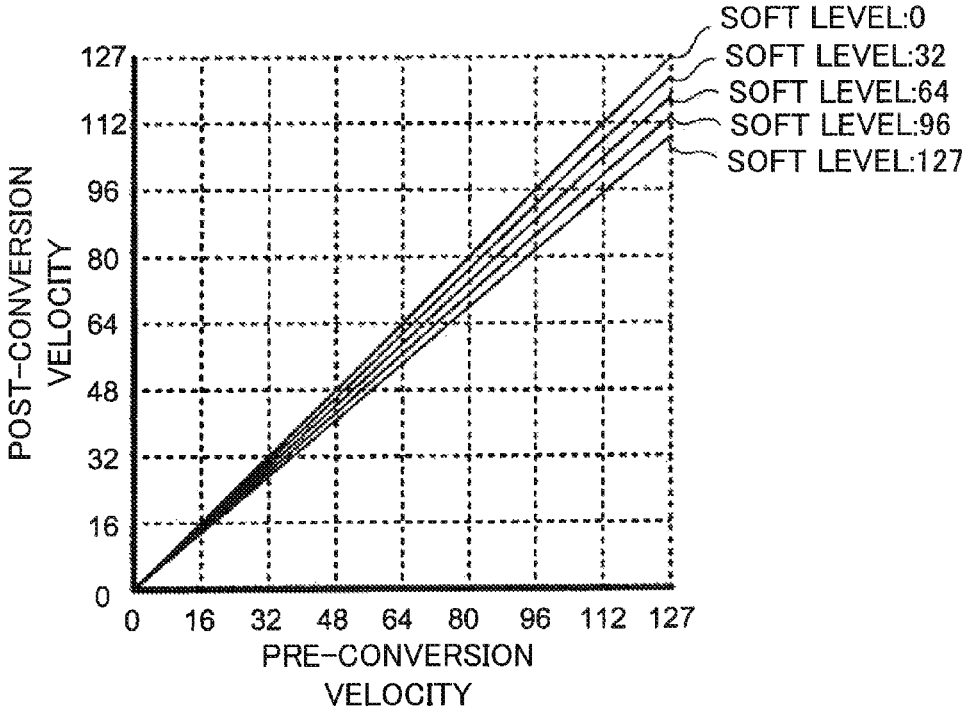
FIG. 5 is a diagram showing an organization of a set of soft pedal log data for use by the controller in the embodiment of the present invention.
FIG. 6 is a graph showing a conversion equation used by the controller for velocity value conversion in the embodiment of the present invention.

FIG. 5 is a diagram showing an organization of a set of the soft pedal log data. The soft pedal log data set comprises a collection of data records corresponding to individual event data having so far been determined to be soft pedal data at step S002, and the soft pedal log data set includes data fields of "timing" and "soft level". The "timing" indicates a value obtained by adding the delta time included in the soft pedal data to an accumulated value of the delta times of the event data having so far been selected at step S001 and then converting the new accumulated value into an absolute time from the start timing of the music piece in light of the time unit data and tempo data. The "soft level" indicates the second parameter of the soft pedal data. The soft pedal log data are used to identify a degree of muting to be performed in driving of the hammer 12 via the key 11 corresponding to the note-on event data as will be described below.

In order to identify such a degree of muting, all of the soft pedal log data from the start timing of the music piece are not necessary. Thus, the controller 172 may discard unnecessary soft pedal data from the soft pedal log data (FIG. 5) at step S102. However, if the storage device 171 has a sufficient storage capacity, the unnecessary soft pedal data need not necessarily be discarded.

If the event data has been determined to be note-on event data at step S002 (i.e., "2" at step S002), the controller 172 references the soft pedal log data (FIG. 5) to identify a numerical value indicative of a degree of muting at timing indicated by the delta time of the note-on event data, at step S201.

More specifically, the controller 172 first converts the delta time included in the note-on event data into an absolute time from the start time of the music piece. The thus-converted absolute time indicates timing at which the strings 13 of a pitch indicated by the first parameter of the note-on event data should be struck by the hammer 12, i.e. generation start timing of a tone (tone (sound) generation start timing). Then, from the data records included in the soft pedal log data set, the controller 172 searches for a data record of which a time indicated by the "timing" is immediately before the tone generation start timing, and the controller 172 identifies a numerical value indicated by the "soft pedal" of the searched-out data record as a numerical value indicative of a degree of muting at string striking timing of the note-on event data.

Then, at step S202, the controller 172 converts (or changes) a value of velocity data, indicated by the second parameter of the note-on event data, in accordance with the above-mentioned soft level (muting data), using a conversion equation prestored in the storage device 171. FIG. 6 is a graph showing the conversion formula used by the controller 172 in the velocity value conversion at step S202 above, where the horizontal axis represents values of the velocity data before the conversion (i.e., pre-conversion velocity values) while the vertical axis represents values of the velocity data after the conversion (i.e., post-conversion velocity values). If the soft level is "0", the pre-conversion velocity and the post-conversion velocity take a same value, so that no velocity change is executed. If the soft level is "1" or more, on the other hand, the post-conversion velocity takes a smaller value than the pre-conversion velocity. Note that the greater the soft level, the greater becomes a degree of decrease of the post-conversion velocity from the pre-conversion velocity.

Figure 7:
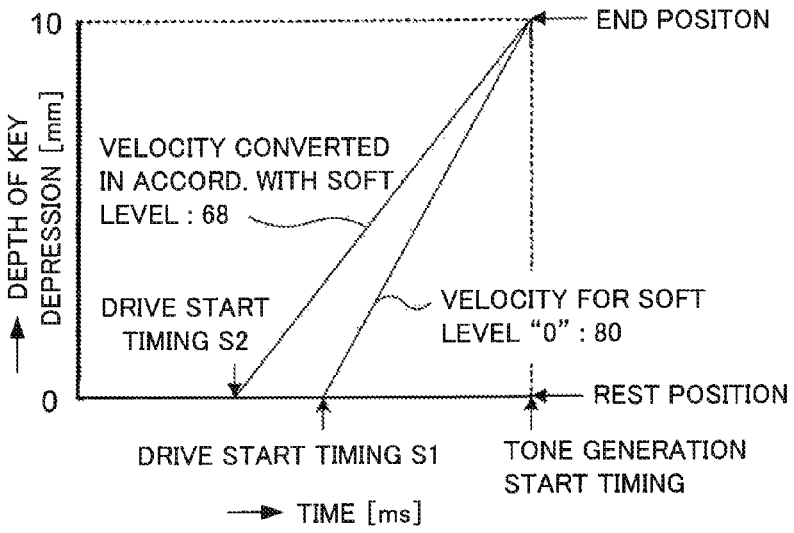
FIG. 7 is a graph showing trajectory data used by the controller in the embodiment of the present invention.

The, at step S203, the controller 172 generates trajectory data corresponding to the post-conversion velocity obtained at step S202 above. The trajectory data is data indicative of variation over time, with respect to the generation start timing of the tone (i.e., timing at which the strings 13 corresponding to the key 11 should be struck) (namely, attainment target), of a depth of key depression at the time of key striking instructed by the note-on event data (in other words, a trajectory of time-vs.-movement positions of the driven hammer 12). FIG. 7 is a graph showing trajectory data in cases where the post-conversion velocity value is "80" and "68", where the horizontal axis represents elapsed times of the start timing of a music piece while the vertical axis represents depths of key depression.

The controller 172 generates the trajectory data in accordance with the following rules.

(a) No matter what the velocity value is, the key 11 should reach an end position (i.e., a position of the key 11 in a most-deeply-depressed state or a most-deeply-depressed position of the key 11) at tone generation start timing indicated by the delta time of the note-on event data. Namely, irrespective of the velocity value, the strings 13 corresponding to the key 11 should be struck by the hammer 12 at striking timing designated by the note-on event data (striking data).

(b) A velocity at which the key 11 moves from a rest position (i.e., a position of the key 11 in a non-depressed state or a non-depressed position of the key 11) to the end position should be made constant. Namely, the hammer 12 should be driven at a constant striking velocity corresponding to the velocity value converted at step S202 above. In other words, the moving velocity of the key 11 should be a velocity specified in accordance with a velocity curve stored in the controller 172 (i.e., a velocity corresponding to the converted velocity value). Here, the greater the velocity value, the greater becomes the velocity of the key at the tone generation start timing.

If the controller 172 follows the trajectory data generated in accordance with the aforementioned rules, the greater the post-conversion velocity, the later is made the drive start timing of the key 11 (i.e., drive start timing of the hammer 12), and the smaller the post-conversion velocity, the earlier is made the drive start timing of the key 11 (i.e., drive start timing of the hammer 12). More specifically, in the illustrated example of FIG. 7, the drive start timing $S_2$ for velocity "68" is earlier than the drive start timing $S_1$ for velocity "80". As noted previously, in response to depression of the key 11, the hammer 12 contacting the depressed key 11 is driven to move toward the corresponding strings 13. Thus, the depth of key depression is proportional to a distance between the strings 13 and the key 11. Thus, the trajectory data indicative of variation over time of the depth of key depression is also indicative of variation over time, due to the string striking, of the distance between the hammer 12 and the set of strings 13, i.e. a trajectory of the time-vs.-movement positions of the hammer 12 (hereinafter referred to as "hammer trajectory").

The operation performed at step S203 above is characterized by determining drive start timing of the hammer 12 in accordance with the pre-conversion velocity data and performing control to advance the drive start timing in accordance with the muting data (soft level) in such a manner that the strings 13 corresponding to the key 11 are struck by the hammer 12 at striking timing (tone generation start timing) designated by the delta time of the note-on event data (striking data). By the drive start timing of the hammer 12 being advanced like this, a slope (time-vs.-movement positions) of the hammer trajectory becomes gentle and the striking velocity of the hammer decreases, so that muting is executed.

After the generation the trajectory data at step S203, the controller 172 goes to step S204, where it determines, at sufficiently short time intervals, whether the drive start timing of the key 11 indicated by the generated trajectory data (i.e., the drive start timing of the hammer 12) has arrived or not. If the drive start timing has not arrived yet as determined at step S204 ("NO" determination at step S204), the controller 172 continues to repeat making the determination at step S204 at the predetermined time intervals.

If, on the other hand, the drive start timing has arrived as determined at step S204 ("YES" determination at step S204), the controller 172 instructs the PWM signal generator 174 to sequentially generate a PWM signal of a duty cycle corresponding to a moving velocity etc. of the key 11 of the pitch indicated by the first parameter of the note-on event data and output the generated PWM signal to the key solenoid 15 corresponding to the key 11 in such a manner that the key 11 moves in accordance with the trajectory data. In accordance with such an instruction given from the controller 172, the PWM signal generator 174 generates the PWM signal and outputs the generated PWM signal to the key solenoid 15, so that the key 11 is driven by the key solenoid 15, at step S205.

At step S205, the controller 172 continuously monitors whether a position of the key 11 indicated by position data input from the key sensor 16 via the A/D converter 175 coincides with a position indicated by the trajectory data. If there is a difference between the position of the key 11 indicated by the position data input from the key sensor 16 and the position indicated by the trajectory data, the controller 172 adjusts the duty cycle of the PWM signal to be generated by the PWM signal generator 174. Thus, the key 11 driven by the key solenoid 15 is caused to move generally in accordance with the trajectory data. As a consequence, the hammer 12 strikes the stings 13 at the tone generation start timing indicated by the note-on event data. Also, at the time of the string striking, the velocity of the hammer 12 corresponds to the velocity converted in accordance with a degree of muting at that time point indicated by the soft pedal log data.

If the event data has been determined to be note-off event data at step S002 (i.e., "3" at step S002), the controller 172 first converts the delta time included in the note-off event data into an absolute time from the start timing of the music piece. The thus-converted absolute time indicates timing at which a tone of the strings 13 of a pitch indicated by the first parameter of the note-off event data should be silenced, i.e. tone silencing timing. Then, the controller 172 goes to step S301, where it determines, at sufficiently short time intervals, whether the tone silencing timing has arrived or not. If the tone silencing timing has not arrived yet as determined at step S301 ("NO" determination at step S301), the controller 172 continues to repeat making the determination at step S301 at the predetermined time intervals.

If, on the other hand, the tone silencing timing has arrived as determined at step S301 ("YES" determination at step S301), the controller 172 instructs the PWM signal generator 174 to stop outputting the PWM signal to the key solenoid 15 having so thr been driving the key 11 of the pitch indicated by the first parameter of the note-off event data. In response to such an instruction, the PWM signal generator 174 stops outputting the PWM signal to the key solenoid 15 designated by the controller 172, at step S302. Once input of the PWM signal from the PWM signal generator 174 to the key solenoid 15 is discontinued, stress acting on the key 11 from the key solenoid 15 is eliminated, so that the key 11 moves back to the rest position by virtue of its own weight, gravity imposed on the hammer 12, etc. In response to such movement of the key 11 back to the rest position, the damper 14 corresponding to the key 11 is pressed against the strings 13, so that vibration of the strings 13 stops. As a consequence, the silencing of the tone instructed by the note-off event data is completed.

As noted above, even when the hammer trajectory during the sting striking has been Changed in accordance with the muting data, the driving action of the hammer 12 via the key 11 is controlled by the controller 172 in such a manner that the timing at which the hammer 12 strikes the strings 13 coincides with the tone generation start timing indicated by the note-on event data. As a result, tones constituting the music piece can be audibly generated at accurate timing even in an automatic performance that involves muting based on the muting data.

[Modifications]

The above-described preferred embodiment is merely one specific example of the present invention, and it should be appreciated that the present invention is variously modifiable within the scope of the technical idea thereof as exemplified below.

Whereas the preferred embodiment has been described above in relation to the case where, when the velocity indicative of a string striking intensity is converted in accordance with the muting data, the pre-conversion velocity and the post-conversion velocity should be in a linear functional relationship as shown in FIG. 6, the velocity conversion rule is not so limited. Namely, any other desired conversion rule may be employed as along as a post-conversion velocity calculated from a pre-conversion velocity in a case where muting is instructed in accordance with the muting data is smaller than a post-conversion velocity calculated from the same pre-conversion velocity in a case where muting is not instructed. Further, a post-conversion velocity may be determined using any other construction than the aforementioned construction where the controller 172 determines a post-conversion velocity through an arithmetic operation in accordance with a predetermined calculation formula; for example, an alternative construction may be employed in which the controller 172 performs velocity conversion in accordance with data of a conversion table format that are indicative of correspondency between pre-conversion velocities and post-conversion velocities.

Further, the preferred embodiment has been described above in relation to the case where a velocity indicative of a string striking intensity is converted in accordance with muting data and trajectory data corresponding to the converted velocity is created. However, the scheme for differentiating the string-striking-responsive trajectory data in response to muting based on muting data is not necessarily limited to the one employing the velocity conversion as set forth above; for example, such trajectory data corresponding to muting data may be derived directly.

Figure 8:
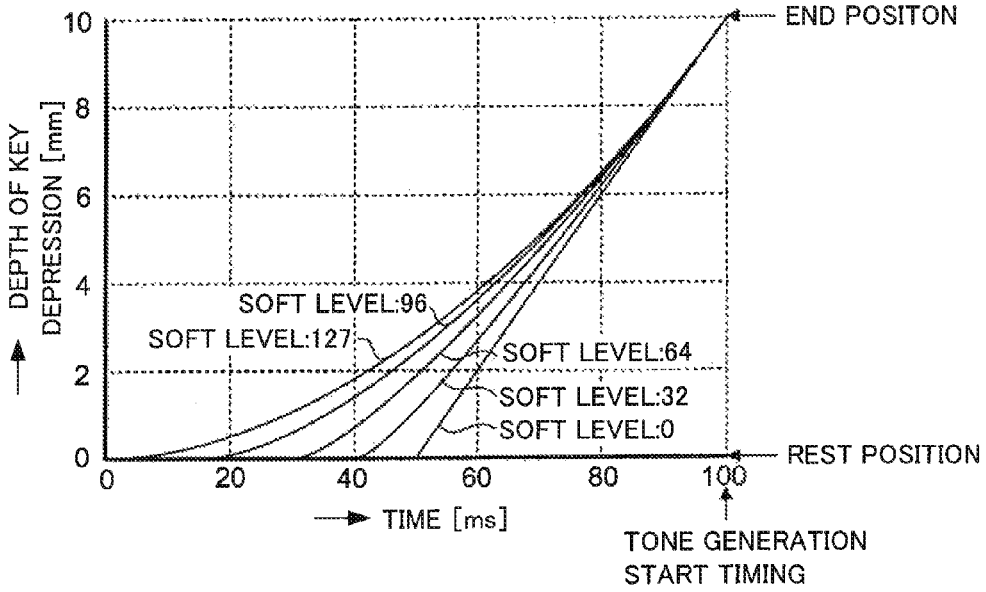
FIG. 8 is a graph showing trajectory data used by the controller in a modification of the embodiment of the present invention.
Figure 9:
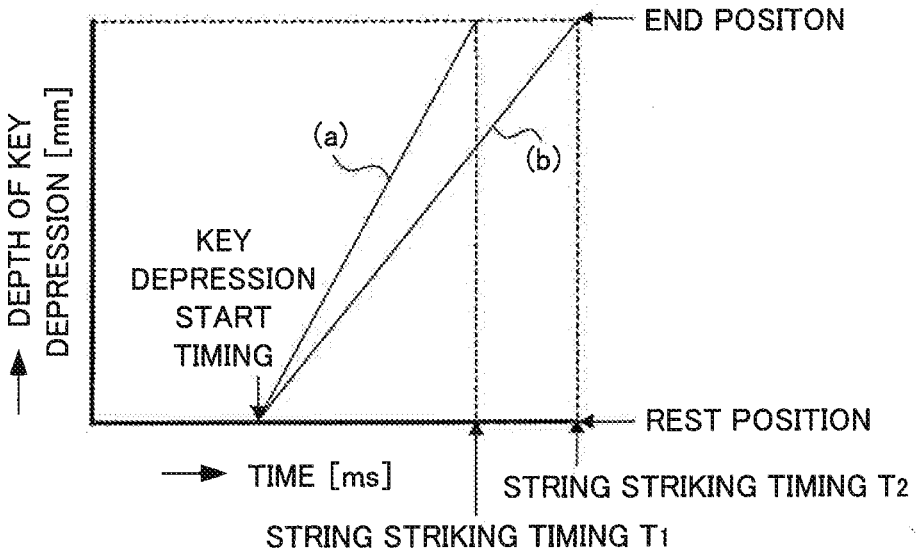
( PRIOR ART ) F I G. 9
FIG. 9 is a graph showing how string striking timing is displaced when muting has been executed in an automatic performance in accordance with a conventionally-known technique.

FIG. 8 is a graph showing a modification where trajectory data corresponding to velocity data included in note-on event data and a soft level indicated by soft pedal data is created by performing acceleration control. Five curves shown in FIG. 8 are each trajectory data corresponding to value "80" of the velocity data. These five curves represent trajectory data corresponding to different values "0", "32", "64", "96" and "127", respectively, of the soft level.

In FIG. 8, a time position of 100 milliseconds on the horizontal axis is tone generation start timing (striking timing). A key velocity at the tone generation start timing (striking timing) is the same among the five curves despite the different soft level values. Namely, the key velocity at the tone generation start timing is 200 millimeters/second that is a value corresponding to the velocity "80". Further, in each of the curves of trajectory data, an initial velocity at the drive start timing is determined in accordance with the value of the soft level, and acceleration in a period from the drive start timing to the tone generation start timing is substantially constant, but it is assumed here that the acceleration takes a different value depending on the value of the soft level. Namely, the greater the value of the soft level, the smaller initial velocity and the greater the acceleration, so that it takes a longer time for a target striking velocity (velocity value) to be reached. Thus, a time length from the drive start timing to the tone generation start timing increases in accordance with the value of the soft level. For example, acceleration corresponding to the individual values of the soft level is determined in such a manner that the key depression time for soft level value "127" is two times as long as the key depression time for soft level value "0", and trajectory data are each created by combining the determined acceleration and the target striking velocity indicated by the velocity data.

For example, trajectory data created for all combinations of velocity values "0"-"127" and soft level values "0"-"127" in accordance with a rule similar to the rule described above in relation to FIG. 8 may be prestored in the storage device 171 so that one trajectory data corresponding to a combination of velocity data and soft level data included in performance data received by the controller 172 can be read out and used. Alternatively, data of a function expression identifiable if velocity data and soft level data are given may be prestored in the storage device 171 so that the controller 172 can identify the function expression in accordance with that data and create trajectory data by computing the function expression with velocity data and soft level data used as variables.

In such modifications, the velocity conversion at step S202 of FIG. 4 can be dispensed with or omitted, and trajectory data corresponding to a velocity indicated by note-on event data and the soft level identified at step S201 is identified directly at step S203.

In the case where the key 11 is driven in accordance with the trajectory data generated in accordance with a rule similar to the rule described above in relation to FIG. 8, a velocity of the hammer 12 at the string striking timing is constant irrespective of the soft level, and thus, generated tones are generally the same in volume. However, a greater value of the soft level causes the hammer 12 to approach the strings 13 at greater acceleration, as a result of which key depression of a careful touch, so-called "key striking from a finger-touched position" or "low-finger key striking", is reproduced so that a tone of a color (timbre) giving a listener a softer impression is generated.

In such a modification too, driving of the key 11 via the key solenoid 15 is controlled by the controller 172 in such a manner that the string striking timing coincides the tone generation start timing indicated by the note-on event data although the key depression time indicated by the trajectory data differs depending on the soft level, and thus, it is possible to prevent the inconvenience that the generation start timing of a tone included in a music piece is displaced due to muting in an automatic performance executed by the auto-playing piano 1.

Furthermore, the preferred embodiment has been described above in relation to the case where the muting data is data indicative of a degree of muting in addition to presence/absence of muting. Alternatively, the muting data may be data indicative of only presence/absence of muting. More specifically, there may be employed an alternative construction in which soft level "0" of the soft pedal data indicates that muting is not executed while each of other soft levels than "0" indicates that muting is executed, and in which same trajectory data is used for a same velocity regardless of which one of "1"-"127" the soft level is.

Further, whereas the preferred embodiment has been described above in relation to the case where performance data are prestored in the storage device 171, the present invention is not so limited. For example, the control unit 17 may include a readout means for reading out performance data stored in an external storage medium so that the control unit 17 receives (acquires) the performance data by reading out the performance data from the storage medium by means of the readout means. As another alternative, the control unit 17 may include a reception means for receiving data from an external device via a network so that the control unit 17 receives (acquires) the data from the external device by means of the reception means. Namely, as the reception section for the auto-playing piano 1 to receive (acquire) performance data, any desired construction may be employed.

Furthermore, whereas the preferred embodiment has been described above in relation to the case where the auto-playing piano 1 is a grand-type auto-playing piano, the auto-playing piano 1 may be of an upright type. Furthermore, the acoustic musical instrument provided with the automatic performance mechanism according to the present invention is not limited to a piano. Namely, the present invention may be applied to any desired auto-playing musical instruments, such as celestas and glockenspiels, as long as the auto-playing musical instruments include sounding members capable of being struck by hammers driven in accordance with performance data.

Furthermore, whereas the preferred embodiment has been described above in relation to the case where the muting data included in the performance data is indicative of presence/absence or depth of depression of the soft pedal, the muting data is not necessarily limited data related to the soft pedal and may be any desired data as long as the data instruct muting.

Furthermore, whereas the preferred embodiment has been described in relation to the case where the delta times included in the soft pedal data are each stored into the data field "timing" of the soft pedal log data (FIG. 5) after being converted into an absolute time from the start time of a music piece, the delta times included in the soft pedal data may be recorded directly into the soft pedal log data so that the controller 172 can calculate generation timing of an event indicated by each of the soft pedal data by accumulating the individual delta times.

It should be appreciated that the specific operational flows, numerical values, graphs, data, etc. used in the above-described embodiment and modifications thereof are merely illustrative and various other operational flows, numerical values, graphs, data, etc. may be used in the present invention.

This application is based on, and claims priority to, JP PA 2012-248703 filed on 12 Nov. 2012. The disclosure of the priority application, in its entirety, including the drawings, claims, and the specification thereof, are incorporated herein by reference.

What is claimed is:

1. A drive control device for a striking member in a sound generation mechanism, the sound generation mechanism including a sounding member adapted to generate a vibration sound in response to being struck by the striking member, said drive control device comprising:

a reception section adapted to receive performance data, the performance data including striking data for designating striking timing at which the sounding member should be struck by the striking member, velocity data indicative of an intensity of striking, by the striking member, of the sounding member, and muting data for controlling muting of a sound; and a controller adapted to determine drive start timing of the striking member in accordance with the velocity data in such a manner that the sounding member is struck by the striking member at the striking timing designated by the striking data, and perform control such that the drive start timing is advanced in accordance with the muting data.

2. The drive control device as claimed in claim 1, wherein said controller changes said velocity data, indicative of an intensity of striking, to weaken the striking in accordance with the muting data, and said controller creates, in accordance with the changed velocity data, a trajectory of time-vs.-movement-positions of the striking member such that the sounding member is struck by the striking member at the striking timing designated by the striking data.

3. The drive control device as claimed in claim 1, wherein said controller creates the trajectory of time-vs.-movement-positions of the striking member such that driving of the striking member is controlled with acceleration corresponding to the muting data and that the sounding member is struck by the striking member at the striking timing designated by the striking data and with an intensity indicated by the velocity data.

4. The drive control device as claimed in claim 1, wherein the sounding member is a string of a musical instrument, and the striking member is a hammer for striking the string.

5. An auto-playing musical instrument comprising:

a drive control device for a striking member in a sound generation mechanism, the sound generation mechanism including a sounding member adapted to generate a vibration sound in response to being struck by the striking member, said drive control device comprising:

a reception section adapted to receive performance data, the performance data including striking data for designating striking timing at which the sounding member should be struck by the striking member, velocity data indicative of an intensity of striking, by the striking member, of the sounding member, and muting data for controlling muting of a sound; and a controller adapted to determine drive start timing of the striking member in accordance with the velocity data in such a manner that the sounding member is struck by the striking member at the striking timing designated by the striking data, and perform control such that the drive start timing is advanced in accordance with the muting data;

a plurality of the sounding members;

a plurality of the striking members each configured to strike a corresponding one of the sounding members; and a drive mechanism configured to individually drive the plurality of the striking members under control of said controller.

6. A computer-implemented method for controlling driving of a striking member in a sound generation mechanism, the sound generation mechanism including a sounding member adapted to generate a vibration sound in response to being struck by the striking member, said method comprising:

a step of receiving performance data, the performance data including striking data for designating striking timing at which the sounding member should be struck by the striking member, velocity data indicative of an intensity of striking, by the striking member, of the sounding member, and muting data for controlling muting of a sound; and a step of determining drive start timing of the striking member in accordance with the velocity data in such a manner that the sounding member is struck by the striking member at the striking timing designated by the striking data, and performing control such that the drive start timing is advanced in accordance with the muting data.

7. A non-transitory computer-readable storage medium storing a program executable by a processor for implementing a method for controlling driving of a striking member in a sound generation mechanism, the sound generation mechanism including a sounding member adapted to generate a vibration sound in response to being struck by the striking member, said method comprising:

a step of receiving performance data, the performance data including striking data for designating striking timing at which the sounding member should be struck by the striking member, velocity data indicative of an intensity of striking, by the striking member, of the sounding member, and muting data for controlling muting of a sound; and a step of determining drive start timing of the striking member in accordance with the velocity data in such a manner that the sounding member is struck by the striking member at the striking timing designated by the striking data, and performing control such that the drive start timing is advanced in accordance with the muting data.

* * * * *